United States Patent [19]

See

[11] 4,161,558

[45] Jul. 17, 1979

[54] FLEXIBLE AND PERMEABLE GROUND COVERING STRUCTURE, PARTICULARLY FOR SPORTING USES

[75] Inventor: Jacques L. A. See, Deauville, France

[73] Assignee: Royalty S.A., Luxembourg, Luxembourg

[21] Appl. No.: 789,979

[22] Filed: Apr. 22, 1977

[30] Foreign Application Priority Data

Apr. 26, 1976 [FR] France ..... 76 12252

[51] Int. Cl.[2] ..... A01N 3/00

[52] U.S. Cl. ..... 428/17; 428/85; 428/95; 428/159; 428/160; 428/166; 428/167; 428/169; 428/172; 428/286; 428/287

[58] Field of Search ..... 428/17, 85, 95, 159, 428/160, 166, 167, 169, 172, 286, 287; 404/2, 18, 35, 40, 41, 44, 47, 49, 64, 67; 272/3, 56.5 R, 56.5 SS, 59 R, 70; 273/27, 29 R, 32 R, 55 R, DIG. 13

[56] References Cited

U.S. PATENT DOCUMENTS

| | | | |
|---|---|---|---|
| 2,515,847 | 7/1958 | Winkler | 428/17 |
| 3,157,557 | 11/1964 | Palmer | 428/17 |
| 3,433,137 | 3/1969 | Henderson | 428/17 |
| 3,446,341 | 5/1969 | Kutik | 428/17 |
| 3,574,107 | 4/1971 | Hurka | 428/17 |
| 3,661,687 | 5/1972 | Spinney | 428/17 |

*Primary Examiner*—Marion E. McCamish
*Attorney, Agent, or Firm*—Browdy and Neimark

[57] ABSTRACT

The ground covering structure comprises a porous and resilient underlayer made of synthetic material forming open meshes or alveoles and which is anchored to the ground, and water-pervious vault forming elements having holes or slots through which water may flow, also made of synthetic material, with the formed vaults having a concavity turned towards the ground. The elements include means for their connection with the underlayer on which they are applied and having a top provided with shags or filaments having free ends, with the free ends of said shags or filaments all ending substantially in the same plane.

8 Claims, 13 Drawing Figures

FLEXIBLE AND PERMEABLE GROUND COVERING STRUCTURE, PARTICULARLY FOR SPORTING USES

The conventional ground covering structures made of synthetic material, which are provided to be positioned in the open air, such as artificial lawns, ways for golf-courses, ski or luge tracks, etc., must take into consideration different factors, and most of them exhibit many disadvantages. There is always a risk of a progressive sliding of the covering structure with respect to the surface of the ground, and also a risk of a forming of folds, especially in the low portions of the covering structures placed on inclined grounds.

It is also frequent that the ground covering structures have a tendency to sink into the ground on rainy weather and, on the contrary, when the weather is dry and under a hot sun, the differential heat expansions to which the covering structures are submitted, often cause the edges of the elements of the covering structure to raise, which is due to the mutual lateral pushes of these elements. These results therefrom a formation of projections and reliefs which can be dangerous, and can particularly be the cause of falls by people playing thereon.

Another disadvantge of many ground covering structures is that they are impermeable or substantially impermeable both to air and to water, which causes fermentations to occur beneath these structures.

The present invention copes with these various disadvantages by creating a new ground covering structure making possible to realize a catching or anchorage with the ground, without any risk of forming folds, even on grounds having an important slope and submitted to temperature changes.

Besides, the covering structure of the invention exhibits a very good elasticity in the vertical direction and a great porosity, while the risks of sinking are practically avoided.

According to the invention, the ground covering structure comprises a porous and resilient underlayer made of synthetic material forming open meshes or alveoles and which is anchored to the ground, and vault forming elements having holes or slots through which water may flow, also made of synthetic material, with the formed vaults having a concavity turned towards the ground, said elements including means for their connection with the underlayer on which they are applied and having a top provided with shags or filaments having free ends, with said free ends of said shags or filaments all ending substantially in the same plane.

Various other features of the invention are morever shown in the following detailed description.

Embodiments of the invention are shown by way of nonrestrictive examples in the accompanying drawings, wherein.

Figure 1:
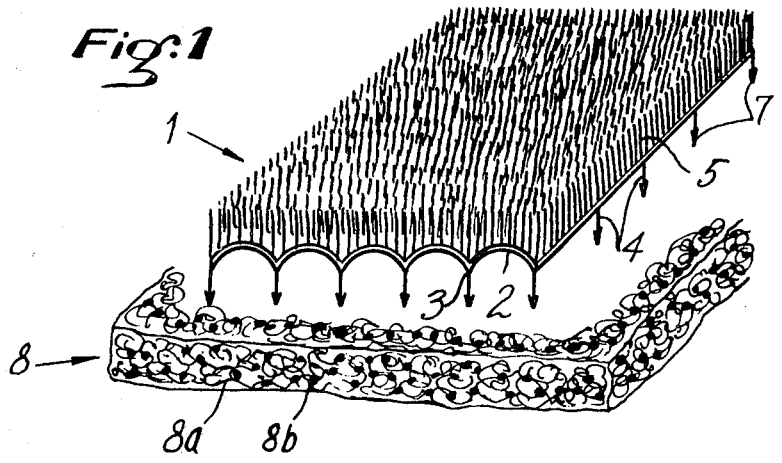
FIG. 1 is an exploded partial and diagrammatic perspective view illustrating an embodiment of the invention.
Figure 5A:
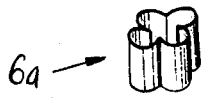
Figure 5B:
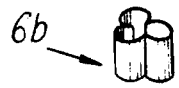
Figure 6:
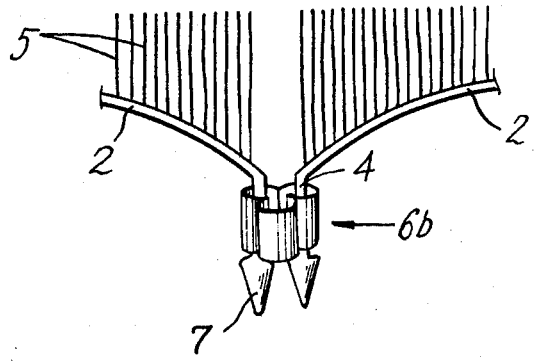
Figure 7:
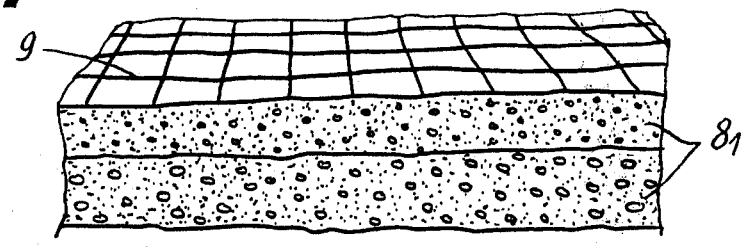
Figure 8:
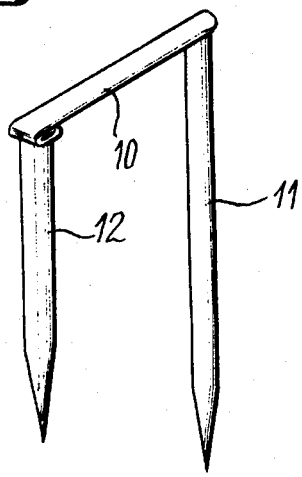
Figure 9:
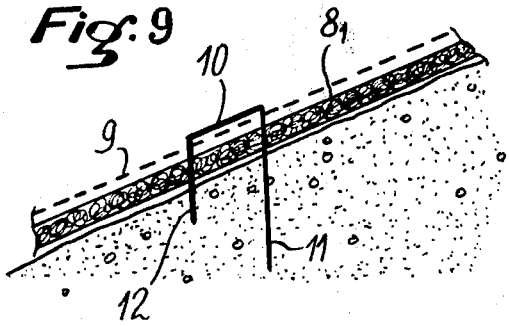
Figure 10:
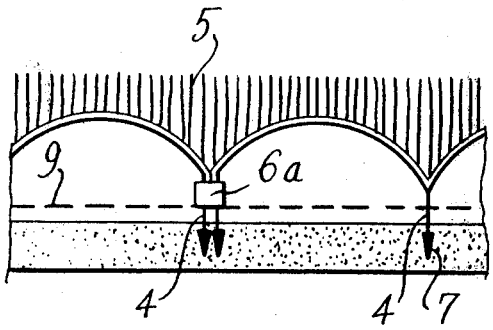
Figure 11:
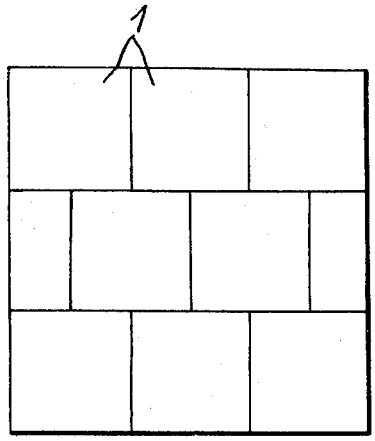
Figure 12:
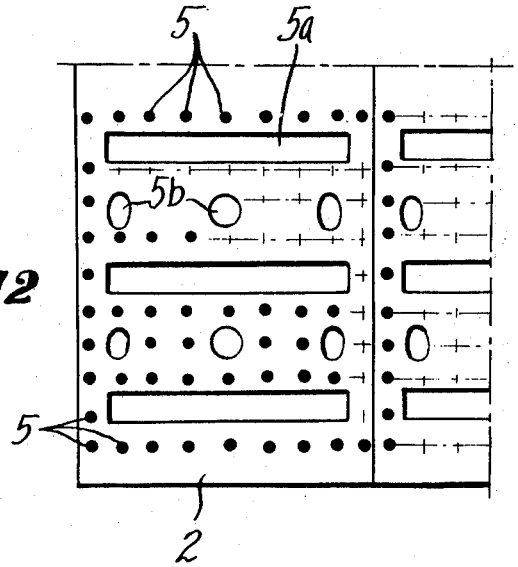

FIGS. 5*a* and 5*b* are perspective views of connection rings used in the embodiments of the invention;

FIG. 6 is a diagrammatic perspective view illustrating the assembling of two upper elements;

FIG. 7 is a partial diagrammatic perspective view of a variant of embodiment of the lower element of FIG. 1;

FIG. 8 is an enlarged perspective view of a fixing stake or arch;

FIG. 9 is a diagrammatic cross-sectional view illustrating the use of the stake or arch of FIG. 8;

FIG. 10 is a cross-sectional view illustrating the way of assembling two upper elements and also the way of assembling of these elements on the lower element;

FIG. 11 is a diagram illustrating, in plane view, an advantageous way of assembling of upper elements;

FIG. 12 is a plane enlarged view, from beneath, of a portion of an upper element.

The covering structure is constituted by two main elements respectively shown at 1 and 8.

The elements 1 constitute the upper portion and are preferably realized through moulding a thermoplastic material to form square, rectangular or otherwise shaped flooring-tiles. The elements 1 delimit parallel vaults 2 separated by folds 3, preferably of a sharp shape.

Figure 2:
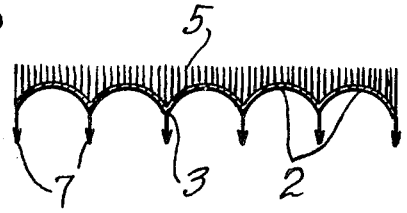
FIG. 2 is a diagrammatic cross-sectional view of the upper element represented in FIG. 1.

The elements 1 are provided, on the beneath portion thereof, with projections or barbs 4 which are advantageously arrow shaped ended as shown at 7. The elements 1 are provided, on the top thereof, with wires, shags or fingers 5 which extend vertically from the vaults 2. The shags 5 are of variable length so that the free end thereof is in a same plane, as well illustrated in FIG. 2.

Figure 3:
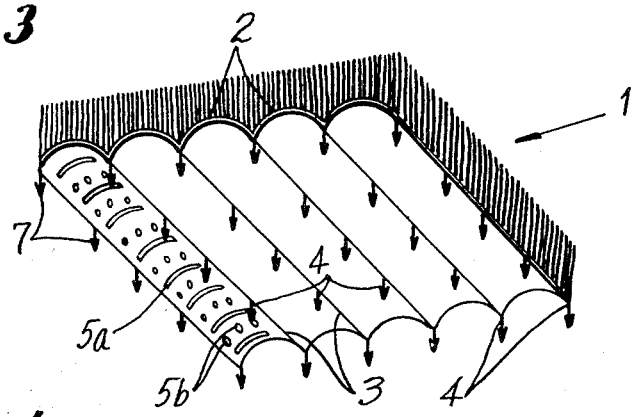
FIG. 3 is a perspective view, seen from beneath, of the element represented at the upper portion of FIG. 1.
Figure 4:
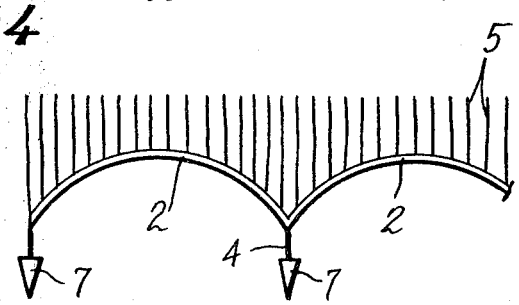
FIG. 4 is an enlarged diagrammatic cross-sectional illustrating a detail of embodiment.

Slots, such as shown at 5*a* and holes, such as shown at 5*b* (FIGS. 3 and 12) are designed in the vaults 2 to enable the flow of the water and also to possibly adjust the flexibility of the tiles.

It should be noted that the realization of the upper elements constituted as described in the above disclosure, make possible to obtain a structure exhibiting a certain flexibility due to the combination of the flexibility of the vaults 2 which is added to the flexibility of the shags or filaments 5 which can form a synthetic lawn. This embodiment makes that, in case of a heat expansion due for instance to the sun on a portion of the coating structure, the increases of the surface areas caused by said heat expansion are absorbed by the vaults 2 which are becoming more or less incurved, and by the slots and holes 5*a*, 5*b* which are distorted.

The upper elements 1 are laterally fixed together by means of resilient rings 6*a* or 6*b* (FIGS. 5*a* and 5*b*) which are slipped on the barbs 4 as illustrated in FIGS. 6 and 10, the arrow shaped ends 7 retaining the rings in position.

As shown in FIGS. 5*a* and 5*b*, the rings have in plane substantially the shape of a clover with three or four leaves which makes possible to assemble the barbs 4 of two, three or four flooring-tiles. The flooring-tiles, as that of FIG. 1 can be assembled together according to various positions and, for example, in alternate rows as illustrated in FIG. 11.

The lower element 8 has the shape of a flexible layer which, preferably, and as illustrated in FIG. 1, is realized by a kind of loose mesh felt material constituted from threads 8*a*, made of synthetic material which are intermingled while forming loops and which are interconnected from place to place as shown at 8*b* to form a layer with great open alveoles. The layer 8 can also comprise layers $8_1$ made of foamed synthetic resin and in such a way that the alveoles thus formed are open to enable the layer to be porous, as illustrated in FIG. 7. In that latter case it is advantageous to cover the layers $8_1$ with a wire-netting 9.

The layer 8 constituting the lower element has advantageously the shape of bands which are laid edge to edge directly on the ground.

To hold the layer 8 on the ground, there are advantageously used stakes as that represented in FIG. 8, which have the shape of an arch 10 with legs 11, 12 of un-equal lengths. FIG. 9 shows that the stakes 10 in the shape of arches pass through the layers 8 or $8_1$, and the wire-netting 9 if used. On sloppy grounds, it is advantageous that leg 11, the longest, be placed upstream, which gives to the arch-shaped stakes a great resistance to tearing.

When the lower element 8 is fixed as explained in the above disclosure, the upper elements 1 which are pre-assembled, have just to be put into place. The barbs 4 of the upper elements pass through the meshes of the wire-netting when used and are inserted, due to the arrow shaped ends 7, into the loops 8*b* or into the open-pored foamed synthetic structure. The barbs can move laterally into the loops, especially when the same are formed by threads intermingled as horsehair, which permits to compensate for the distortions caused by the temporary or permanent application of forces or due to the heat expansion, without any risk of getting unanchored whatever be the direction of the various forces acting on the upper element 1.

I claim:

1. Ground covering structure comprising in combination a porous and resilient underlayer made of synthetic material comprising loose mesh felt or open-pored foamed synthetic resin, means for anchoring said underlayer onto the ground, and an upper element formed with a succession of adjacent vault forming elements having holes or slots through which water may flow and having a concavity turned towards the underlayer, said vault forming elements being provided with means for connection with said porous and resilient underlayer, the top of said vault forming elements having shags or filaments with a free end, said free ends of said shags or filaments all ending substantially in the same plane.

2. Covering structure as set forth in claim 1, wherein the underlayer anchored in the ground is constituted from threads made of synthetic material, intermingled while forming loops, and which are connected together from place to place to constitute a loose mesh felt material.

3. Covering structure as set forth in claim 1, wherein the successive vaults of the upper elements are connected together by sharp folds.

4. Covering structure as set forth in claim 1, wherein the upper elements forming the vaults have a bottom portion provided with projecting fingers or barbs extending from the edges and folds of the vaults.

5. Covering structure as set forth in claim 4, wherein the projecting fingers or barbs are terminated by arrow shaped ends forming retaining means into the underlayer.

6. Covering structure as set forth in claim 4, comprising connecting rings for the fingers or barbs of several elements forming the vaults and having to be assembled to the sheet anchored to the ground.

7. Covering structure as set forth in claim 1, comprising a wire-netting placed between the top of the underlayer anchored to the ground and the bottom of the elements forming the vaults.

8. Covering structure as set forth in claim 1, wherein the underlayer is anchored to the ground by means of stakes in the shape or arches with legs of un-equal lengths.

* * * * *